United States Patent [19]

Skogen

[11] Patent Number: 4,492,000

[45] Date of Patent: Jan. 8, 1985

[54] CHIMNEY CLEANER

[76] Inventor: Kermit J. Skogen, Rte. 1, Box 199, Princeton, Minn. 55371

[21] Appl. No.: 379,487

[22] Filed: May 18, 1982

[51] Int. Cl.[3] ..... F23J 3/02

[52] U.S. Cl. ..... 15/242

[58] Field of Search ..... 15/242, 243, 162, 163, 15/236 C; 294/97, 89 S

[56] References Cited

U.S. PATENT DOCUMENTS

| | | | |
|---|---|---|---|
| 195,445 | 9/1877 | Dickerson | 15/243 |
| 1,104,262 | 7/1914 | Herle | 15/104.15 |
| 1,392,202 | 9/1921 | Nechville | 15/243 |
| 1,582,309 | 4/1926 | Satterberg | 15/243 |
| 1,615,733 | 1/1927 | Wold | 15/242 |
| 2,710,765 | 6/1955 | Arens | 294/50.8 |
| 3,604,042 | 10/1969 | Bremner et al. | 15/104.13 |
| 4,279,052 | 7/1981 | Evrand et al. | 15/104.09 |

*Primary Examiner*—Edward L. Roberts
*Assistant Examiner*—Michael Knick
*Attorney, Agent, or Firm*—Harvey B. Jacobson

[57] ABSTRACT

A horizontal mount is provided having opposite side portions and central structure for attaching the lower end of an elongated upstanding support member thereto disposed generally normal to a plane extending between and along the mount opposite side portions. A pair of depending arms are provided and pivot structure pivotally supports the upper end portions of the support arms from corresponding opposite side portions of the mount for independent swinging of the arms about generally parallel axes extending along the mount opposite side portions between extended downwardly and outwardly divergent positons and retracted generally parallel positions disposed generally normal to the aforementioned plane. The free end portions of the arms have fluted rollers journaled therefrom for rotation about axes generally paralleling the first mentioned axes and spring structure is operatively connected between the arms independent of the mount yieldingly biasing the arms toward the extended positions thereof. A pair of opposite marginal edge portions of the mount extend between corresponding ends of the aforementioned opposite side portions of the mount and include limit structures for limiting swinging movement of the arms toward their extended and retracted positions. The fluted rollers comprise cylidrical hubs having longitudinally extending generally radial blades secured to the outer surfaces thereof with the outer longitudinal edges of the blades sharpened.

2 Claims, 7 Drawing Figures

CHIMNEY CLEANER

BACKGROUND OF THE INVENTION

With the increased use of wood burning heaters, fireplace inserts and fireplace heat exchange units, domestic chimney flues are experiencing a quicker build-up creosote and soot. Accordingly, there is a need for domestic chimney flues to be cleaned more frequently and to be cleaned more thoroughly in order to prevent flue fires.

While various forms of cleaners suitable for cleaning chimney flues heretofore have been designed, most of these previous cleaners incorporate at least some structural features which either do not offer maximum cleaning capability or require excessive operational time in order to effect a proper cleaning operation. Accordingly, a need exists for an improved form of chimney flue cleaner specifically designed for use in conjunction with domestic chimney flues and which incorporates structual and operational features enabling a thorough flue cleaning operation to be carried out in a minimum of time by a single workman.

Examples of various forms of cleaning devices, including some of the structural and operational features of the instant invention, are disclosed in U.S. Pat. Nos. 1,104,262, 1,582,309, 1,615,733, 3,604,042 and 4,279,052.

SUMMARY OF THE INVENTION

The chimney flue cleaner of the instant invention incorporates a main body or mount portion includng first and second pairs of opposite side portions. The mount is designed to be removably supported from the lower end of an elongated upstanding support member by which the mount may be lowered down into a chimney flue from the upper end thereof. One pair of opposite side portions of the mount pivotally supports the upper ends of a pair of upstanding support arms therefrom for oscillation relative to the mount about generally parallel axes extending along the first pair of opposite side portions of the mount. The arms swingable between a laterally outwardly extended position with the lower ends thereof inclined downwardly and outwardly and retracted positions with the arms disposed in substantially parallel vertical positions. The lower ends of the arms each support a flutted roller therefrom for rotation about an axis generally paralleling the axis of oscillation of the corresponding arm and spring structure is operatively connected between the arms independent of the mount from which the arms are supported and yieldably biases the arms toward their extended positions. The flutted rollers include generally cylindrical hub portions and circumferentially spaced and longitudinally extending radial vanes or blades supported from the outer surfaces of the cylindrical hub portions and including sharpened outer edges extending longitudinally of the rollers. The sharpened outer edges, when the cleaner is disposed within a chimney flue and vertically oscillated therein, successively bite into and chip away any coating of soot or creosote on the inner surfaces of the chimney flue.

Inasmuch as there is necessarily some slippage between the blades carried by the rollers and the chimney flue as the cleaner is oscillated up and down within an associated flue, each sharpened blade edge successively engages slightly different longitudinally spaced surfaces of the associated flue with the result that an extremely effective cleaning action is produced enabling the inner surfaces of the flue to be cleaned of accumulated soot and creosote in a reasonably short period of time. Further, although an elongated support member is provided by which the cleaner may be lowered into a chimney flue from the upper end thereof and vertically oscillated within the flue, the cleaner also includes an anchor whereby one end of a flexible tether member may be anchored to the cleaner and to a person or object disposed exteriorly of the upper end of the associated chimney flue.

The main object of this invention is to provide a chimney flue cleaner which will be capable of effectively cleaning accumulations of soot and creosote from the inner surfaces of square or rectangular cross-sectional domestic chimney flues.

Another object of this invention is to provide a flue cleaner constructed in a manner whereby the desired cleaning action on an associated chimney flue may be carried out in a minimum amount of time and with a minimum amount of effort by a single workman.

Yet another object of this invention is to provide a chimney cleaner in accordance with the preceding objects and which may be readily utilized in conjunction with square or rectangular cross-sectional chimney flues of different sizes.

Still another object of this invention is to provide a chimney flue cleaner incorporating a safety tether.

Another very important object of this invention is to provide a chimney cleaner of lightweight construction thereby enabling the cleaner to be operated by an attendant worker on successive jobs over the period of a workday without the workman becoming excessively tired.

A final object of this invention to be specifically enumerated herein is to provide a chimney cleaner in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
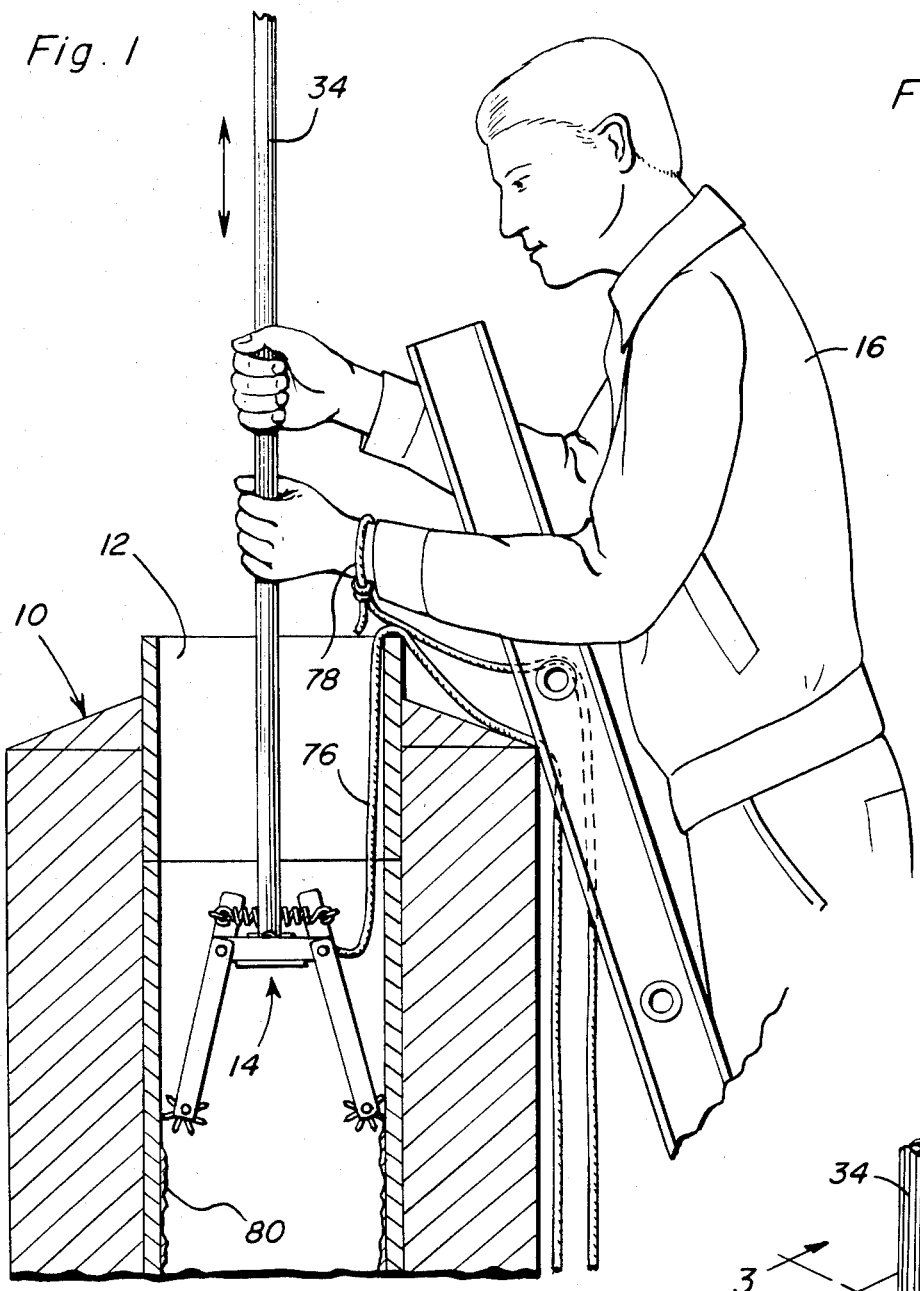
FIG. 1 is a fragmentary vertical sectional view of the upper end portion of a typical chimney flue with the cleaner of the instant invention operatively associated with the flue and supported by a workman.
Figure 7:
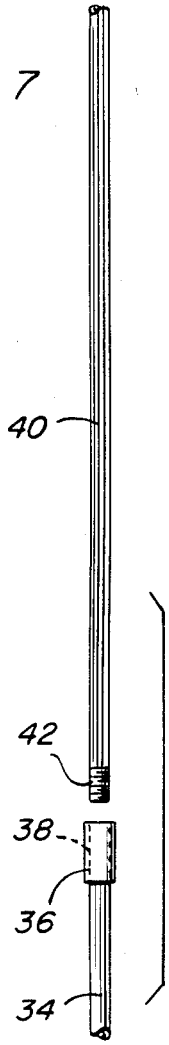
FIG. 7 is a fragmentary exploded elevational view illustrating the connection between adjacent handle portions of the cleaner.

Referring now more specifically to the drawings, the numeral 10 generally designates a chimney including a flue liner 12. The chimney cleaner of the instant invention is referred to in general by the reference numeral 14 and may be operated by a workman 19 disposed to the exterior of the upper end of the chimney 10.

The cleaner 10 includes a horizontal mount or base plate 18 having first and second pairs of opposite side marginal portions 20 and 22. The marginal portions 22 include upstanding parallel flanges 24 extending therealong and the central area of the mount or plate 18 has a vertical bore 26 formed therethrough. A mounting fitting 28 is secured over the upper surface of the central portion of the mount 18 by a threaded fastener 30 secured upwardly through the bore 26 and threadedly engaged in the fitting 28 and the upper end of the fitting 28 includes an upstanding cylindrical projection 32 telescoped and secured in the lower end of an elongated upstanding support member or handle section 34. The upper end of the handle section 34 includes an enlarged end 36 formed thereon having a threaded blind bore 38 formed therein. A second elongated support member or handle section 40 is externally threaded on its lower end as at 42 and the lower end 42 may be removably threadedly engaged in the bore 38. Of course, the upper of the handle section 40 also includes an enlarged end, such as the enlarged end 36 and additional handle sections 40 may be removably coupled together in order to provide an operating handle of the desired length.

The longitudinal midportion of one of the flanges 24 includes an abutment flange 44 secured thereto in any convenient manner, such as by welding for a purpose to be hereinafter more fully set forth, and the remote marginal portion 22 of the mount 18 includes an underlying abutment plate 46 secured thereto for a purpose to be hereinafter more fully set forth. Still further, the marginal portion 22 additionally includes an upstanding anchor eye 48 secured thereto.

Figure 2:
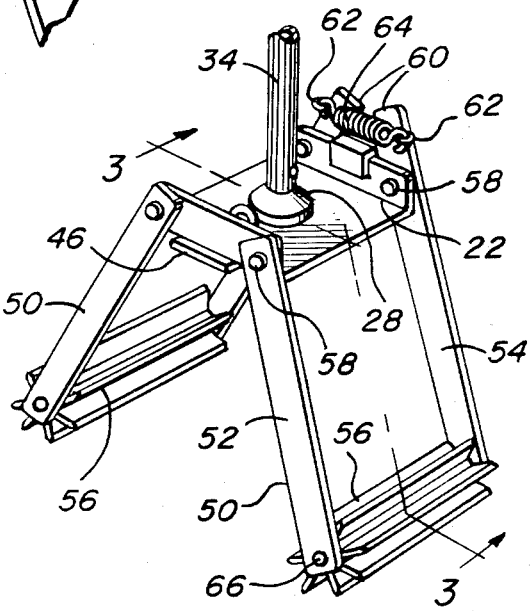
FIG. 2 is a perspective view of the lower portion of the cleaner.
Figure 3:
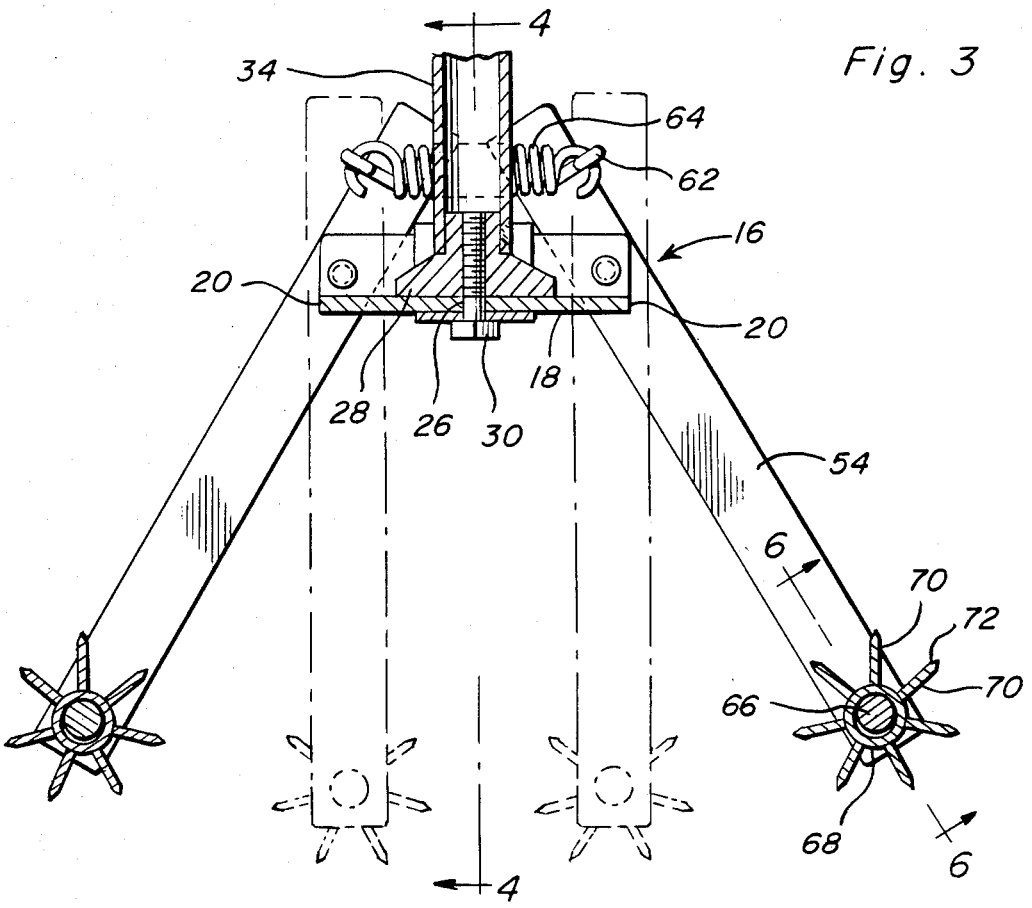
FIG. 3 is an enlarged vertical sectional view taken substantially upon the plane indicated by the section line 3—3 of FIG. 2 and with an inwardly retracted position of the roller supporting arms of the cleaner illustrated in phantom lines.
Figure 4:
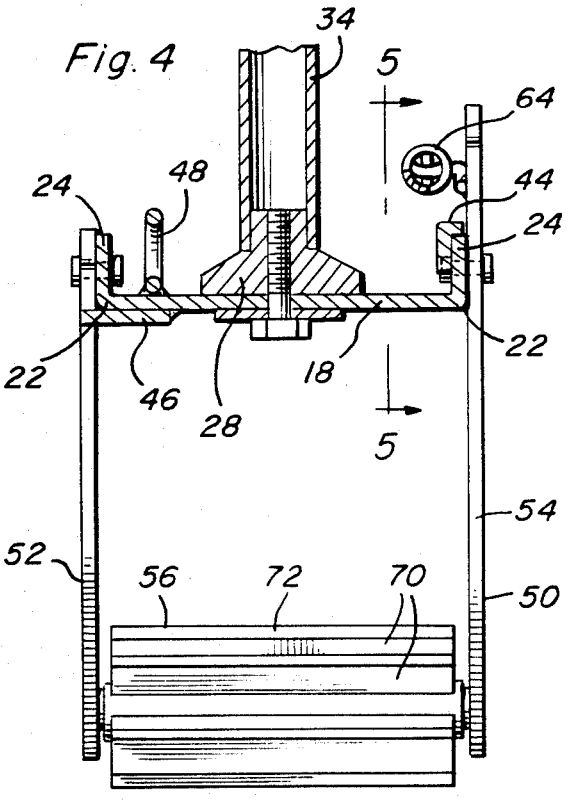
FIG. 4 is a vertical sectional view taken substantially upon the plane indicated by the section line 4—4 of FIG. 3.
Figure 5:
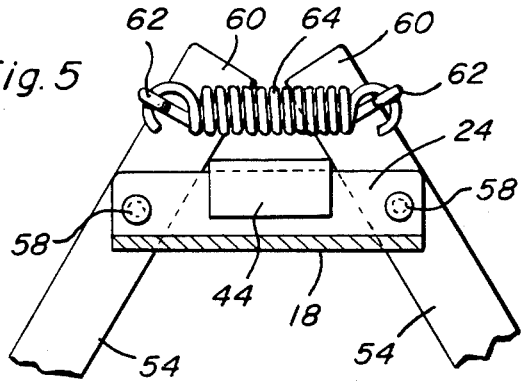
FIG. 5 is a fragmentary vertical sectional view taken substantially upon the plane indicated by the section line 5—5 of FIG. 4.
Figure 6:
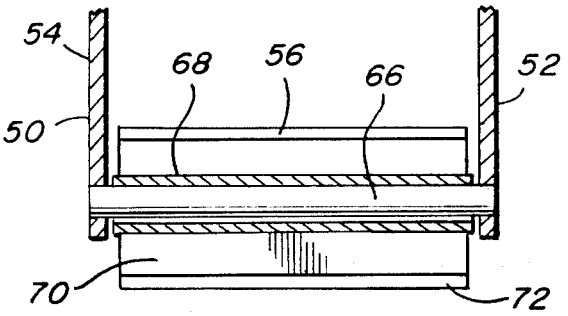
FIG. 6 is a fragmentary sectional view taken substantially upon the plane indicated by the section line 6—6 of FIG. 3.

The cleaner 14 includes a pair of support arms 50 each comprising a pair of short and long links 52 and 54. Each pair of links 52 and 54 parallel each other and have a roller 56 journaled between one pair of corresponding ends thereof while the other pair of corresponding ends of each pair of links 52 and 54 are pivotally secured to the flanges 24 through the utilization of pivot fasteners 58. The long links 54 include end extensions 60 which project past the corresponding pivot fasteners 58 and upwardly above the flange 24 having the abutment flange 44 secured thereto. Each of the extensions 60 includes an anchor hook 62 supported therefrom and an expansion spring 64 has its opposite ends removably engaged with the anchor hooks 62. In this manner, the expansion spring 64 serves to yieldingly bias the support arms 50 toward positions with the lower ends thereof downwardly and outwardly divergent as illustrated in FIG. 2 of the drawings, the extensions 60 abutting against the abutment flange 44 to limit outward swinging movement of the lower ends of the support arms. In addition, when the support arms 50 are swung inwardly against the biasing action of the spring 64, inward swinging movement of the support arms 50 is limited by contact of the links 52 with the abutment plate 46.

The lower ends of the support arms 50 have pivot shafts 66 secured between the links 52 and 54 thereof and each of the support shafts 66 loosely rotatably journals a cylindrical member 68 comprising the hub of the corresponding roller 56. In addition, each roller 56 includes seven longitudinally extending and equally circumferentially spaced apart radial plates or blades 70 supported therefrom with the inner marginal edges of the plates 70 anchored relative to corresponding outer surface portions of the cylindrical member 68 and the outer marginal portions of the blades 70 being bevelled or otherwise sharpened as at 72. The number of blades 70 is important in that when one of the rollers 6 has the outer edges of two of its blades 70 engaged with a planar surface, each blade engaged with the surface is disposed at approximately 64° or 65° relative to that surface. Although slightly less or greater inclinations of the blades 70 relative to such surfaces will also be operative to achieve the desired function, it has been found that the utilization of seven blades 70 provides the ultimate inclination of the blades 70 to a surface along which the rollers 56 may be rolled.

In operation, one end of a safety line 76 is anchored to the eye 48 and the other end of the safety line 76 may be anchored exteriorly of the chimney 10 such as to the wrist of the workman 16 as at 78. Then, the arms 50 have their lower free ends biased toward each other and the cleaner 14 is inserted into the upper end of the flue liner 12. Thereafter, the handle section 34 may be utilized to vertically oscillate the cleaner 14 within the chimney liner 12. During such vertical oscillation of the cleaner 14, the roller 56 thereof chip into and removed the accumulated layer 80 of soot and creosote. As the cleaner 14 is gradually reciprocated within the liner 12 at lower elevations, additional handle sections 40 may be added to the handle section 34 as required. The cleaner 14 is of lightweight construction and if it is dropped the line 76 may be used to upwardly retrieve the cleaner 14 through the flue liner 12.

After opposing sides of the flue liner 12 have been cleaned, the cleaner 14 is upwardly removed from the liner 12 and again downwardly inserted therein and vertically reciprocated in a position rotated 90° about a vertical axis from the position thereof illustrated in FIG. 1 in order that the other pair of opposing inner walls of the flue liner 12 may be cleaned.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A chimney cleaner including a mount having opposite side portions, an elongated upstanding support member having a lower end, means on said mount attaching the lower end of said support member to said mount between said opposite side portions and with said support member disposed generally normal to a plane extending between and along said opposite side portions, a pair of depending support arms including upper base and lower free end portions, pivot means pivotally supporting said upper base end portions from corresponding opposite side portions of said mount for independent swinging of said arms about generally parallel axes extending along said opposite side portions between extending downwardly and outwardly divergent positions and retracted generally parallel positions disposed generally normal to said plane, said free end portions of said arms having fluttered rollers loosely journaled therefrom for rotation about axes generally paralleling the first mentioned axes, spring means operatively connected between said arms independent of said mount yieldingly biasing said arms toward said extended positions, said arms each including a pair of depending long and short parallel links, each of said rollers being journaled between the lower ends of the associated pair of links, the upper ends of each pair of links being pivotally supported from said mount, said mount including a first portion disposed below said first mentioned axes engageable by corresponding short links of said arms to limit swinging movement of said arms to said retracted positions, said upper ends of said long links defining upper end extensions projecting above the first mentioned axes, said spring means including expansion spring means operatively connected between said extensions, said mount including a second abutment portion disposed above said first mentioned axes and engageable by said extensions to limit swinging movement of said support arms toward the extended positions thereof, each of said rollers including a cylindrical hub portion and longitudinally extending generally radial flutes having sharpened outer edges.

2. The combination of claim 1 wherein the flutes on each of said hub portions equal seven in number.

* * * * *